US009737750B2

(12) United States Patent
Garcia Lopez

(10) Patent No.: US 9,737,750 B2
(45) Date of Patent: Aug. 22, 2017

(54) BENCH FOR PERFORMING HIP EXTENSIONS WITH A BAR

(71) Applicant: Arturo Garcia Lopez, Malaga (ES)

(72) Inventor: Arturo Garcia Lopez, Malaga (ES)

( * ) Notice: Subject to any disclaimer, the term of this patent is extended or adjusted under 35 U.S.C. 154(b) by 0 days.

(21) Appl. No.: 14/655,928

(22) PCT Filed: Dec. 5, 2013

(86) PCT No.: PCT/ES2013/070844
§ 371 (c)(1),
(2) Date: Jun. 26, 2015

(87) PCT Pub. No.: WO2014/102414
PCT Pub. Date: Jul. 3, 2014

(65) Prior Publication Data

US 2015/0321045 A1 Nov. 12, 2015

(30) Foreign Application Priority Data

Dec. 28, 2012 (ES) ..... 201232066
Oct. 10, 2013 (ES) ..... 201331495

(51) Int. Cl.
*A63B 26/00* (2006.01)
*A63B 21/00* (2006.01)
(Continued)

(52) U.S. Cl.
CPC ..... *A63B 21/1457* (2013.01); *A63B 21/0442* (2013.01); *A63B 21/0783* (2015.10);
(Continued)

(58) Field of Classification Search
CPC ... A63B 21/078; A63B 21/0783; A63B 21/06; A63B 21/4029; A63B 21/0428;
(Continued)

(56) References Cited

U.S. PATENT DOCUMENTS 3,948,513 A * 4/1976 Pfotenhauer ..... A63B 21/00047 482/142
4,249,726 A * 2/1981 Faust ..... A63B 21/00181 482/104
(Continued)

FOREIGN PATENT DOCUMENTS

WO 2011142537 A2 11/2011

OTHER PUBLICATIONS

International Search Report dated Feb. 28, 2014 for Application No. PCT/ES2013/070844 and English translation.

*Primary Examiner* — Stephen R Crow
*Assistant Examiner* — Megan Anderson
(74) *Attorney, Agent, or Firm* — Lucas & Mercanti, LLP

(57) ABSTRACT

The invention relates to a bench, which is designed for performing hip extensions in such a way as to prevent damage to the back of the user, and can be adapted to different sizes. To this end, the bench consists of an H-shaped frame having a middle beam (7) that is slightly shorter than the distance established between the disks (6) of the bar (5) to be lifted, and on which a back rest or seat (14) is provided, comprising height-regulating means, characterized in that the height of the side beams is such that the bar (5) can be rolled over the surface of the beams above the stretched-out body of the user, while the large disks are flush with the ground so as not to limit the range of movement.

7 Claims, 3 Drawing Sheets

(51) Int. Cl.

| | |
|---|---|
| ***A63B 21/04*** | (2006.01) |
| ***A63B 23/02*** | (2006.01) |
| ***A63B 23/04*** | (2006.01) |
| *A63B 21/02* | (2006.01) |
| *A63B 21/078* | (2006.01) |
| *A63B 21/055* | (2006.01) |

(52) U.S. Cl.
CPC ..... *A63B 21/4029* (2015.10); *A63B 23/0205* (2013.01); *A63B 23/0482* (2013.01); *A63B 21/00061* (2013.01); *A63B 21/02* (2013.01); *A63B 21/04* (2013.01); *A63B 21/0428* (2013.01); *A63B 21/0552* (2013.01); *A63B 21/0557* (2013.01); *A63B 21/078* (2013.01); *A63B 2225/09* (2013.01); *A63B 2225/093* (2013.01)

(58) Field of Classification Search
CPC ..... A63B 21/0557; A63B 23/0482; A63B 23/0205; A63B 71/0054; A63B 2225/093; A63B 2225/09; A63B 21/00047; A63B 21/00058; A63B 21/00061; A63B 21/00065; A63B 21/02; A63B 21/04; A63B 21/0442; A63B 21/072; A63B 21/0724; A63B 21/075; A63B 23/02; A63B 23/0211; A63B 23/0233
See application file for complete search history.

(56) References Cited

U.S. PATENT DOCUMENTS

| | | | | |
|---|---|---|---|---|
| 4,775,150 | A | 10/1988 | Graham | |
| 5,141,480 | A * | 8/1992 | Lennox | A63B 21/078 482/104 |
| 5,281,193 | A * | 1/1994 | Colbo, Jr. | A63B 21/078 482/104 |
| 5,346,448 | A * | 9/1994 | Sollo | A63B 21/00181 482/104 |
| 8,808,151 | B1 * | 8/2014 | Whaley | A63B 21/0442 482/129 |
| 2005/0272571 | A1 | 12/2005 | Moring et al. | |
| 2007/0203003 | A1 * | 8/2007 | Brawner | A63B 21/078 482/104 |
| 2009/0264265 | A1 | 10/2009 | Contreras | |

* cited by examiner

-PRIOR ART-

-PRIOR ART-

BENCH FOR PERFORMING HIP EXTENSIONS WITH A BAR

CROSS REFERENCE TO RELATED APPLICATION

This Application is a 371 of PCT/ES2013/070844 filed on Dec. 5, 2013 which, in turn, claimed the priority of Spanish Patent Application No. P201232066 filed on Dec. 28, 2012 and Spanish Patent Application No. P201331495 filed on Oct. 10, 2013, all applications are incorporated herein by reference.

OBJECT OF THE INVENTION

The present invention relates to a gym bench, especially designed to carry out exercises intended to extend the hip with a bar.

The object of the invention is to provide an ergonomic device or bench, having a suitable height for comfortably performing exercises and that makes it possible to work with any type of loads, while being stable and adaptable.

A further object of the invention is to ensure that the bench does not lift up while carrying out physical exercises.

The device thus falls within the scope of the gym apparatus.

BACKGROUND OF THE INVENTION

As is known, in the scope of practical application of the invention, when it comes to exercise different types of muscles, such as, for example, gluteus, by lifting a bar with weights, i.e., a barbell, usually exercises such as "squats" are performed, wherein the users in an upright position and with the bar over their shoulders bend their knees while maintaining their backs as straight as possible, performing upward and downward movements.

However, the reality is that this exercise generates much more stress in quadriceps than in gluteus, such that it is not the most suitable when it comes to developing these muscles.

With the aim of solving this problem, another type of exercise known as "hip thrust" or hip extension with a bar is known, in which the sports persons are seated on the floor, with their backs resting against a bench, their legs bent, and with the barbell arranged over the lower portion of the abdomen, namely between the pubis and the iliac crests, such that, the exercise consists of lifting the waist against the weight of the bar, by means of a hip extension through the action of the gluteus, using the back as a pivoting point for the body, so that in the upper limit position the abdomen is in line with the knees.

Experimentally, it has been demonstrated that this exercise is optimum for developing the gluteus, which is the main hip extensor muscle.

Thus, to carry out this exercise the use of a bench is necessary.

However, the height of the training benches is almost always too high, being it necessary that the bench is provided with means to adjust the height thereof, which is not always the case.

Concurrently, the arrangement of the back facing the bench it is not made such that the back rests against the surface thereof, but on the edge, which means a considerable unpleasant nuisance however cushioned the bench is, which many times is not the case.

According to another of the problems present in this type of exercise, by itself, it is only possible to work in two safe ways, using the own weight of the users themselves or with a bar having disks very large in diameter.

Except for rare occasions, the disks vary in height according to their weight, being the heavier disks those that thanks to their height enable rolling the bar above the body of the users without having to bear the weight thereof until it has been positioned in a suitable position, such that when lighter disks are used, the height of the disk is not enough to make it possible carrying out this operation, so it is necessary the cooperation of a second person to help placing said bar, and removing it at the end of the exercise, with the set of problems and limitations that this entails.

Finally, it is worth highlighting the problem involved in the fact that these type of benches, in spite of being provided with non-slip elements underneath, given the great side effort to which they are subjected in this type of exercise, it is relatively easy for the bench to accidentally move backwards, so it is necessary to immobilize said bench, not being possible to use the walls of the gym for this purpose given that in the upper limit position of the exercise, the heads of the sports persons protrude in the rearward direction relative to the support surface of the bench.

DESCRIPTION OF THE INVENTION

The recommended bench has been designed to solve the problems presented above regarding any and all of the mentioned problems.

To this end, and in a more specific manner, the bench of the invention is made up from a H-shaped frame, in which the central beam has a length slightly shorter than the distance between the disks of the bar to be lifted, so that said bar can be rolled over guides established on the upper portion of the side beams, defining a sort of bridge, the height of which must be such that when the bar is at rest and the larger disks are in place, the latter are substantially flush with the floor, which makes it possible to roll the bar over the bench above the user's body. Should it be higher, the movement range would be limited since it would abut against the bench, which is clearly undesirable.

In the central crossbar, an ergonomic backrest is arranged, provided with height-regulating means, which enables to adapt the bench for sports persons having different heights, as well as, to increase or decrease the movement range, which results in a very important variable when it comes to exercising.

The side beams may include a series of through holes in which lugs are selectively fitted, so as to fix elastic bands, the tension of which has to be overcome while performing the exercises, being arranged either transversely to the user or transversely to the bar to be lifted in alignment with the ends thereof.

Finally, it should be highlighted that the special arrangement of the sliding guides of the bar makes it possible to perform an additional exercise, similar to the aforementioned exercise, but in which the sports persons rest their backs directly onto the floor, i.e., either slightly forward with respect to the back rest or laying down backwards, the feet near the bench and the head on the end portion of the guide, the exercise also consists of lifting the hip by means of an extension against the weight of the bar.

Additionally, it also enables performing a basic exercise, which is one of the most important in the fitness world, i.e., "DEADLIFT". In this exercise, the problem is that unless the large disks are used, the bar is too close to the floor, so the sports person would have to bend over too much, thus generating a lumbar flexion (very dangerous) and making the technique involved too difficult.

In this way, a very ergonomic bench is achieved, which is extremely multifunctional, comfortable, safe and easy to use.

In an embodiment variant, which involves an improvement of the disclosed bench it has been foreseen that the H-shaped frame includes intermediate offshoots, projecting downwards, forming legs that together with the extension at the ends of the side beams of the H-shaped frame, define three pairs of side legs for said frame, with the especial particularity that between the pair of rear legs and the pair of intermediate and additional legs, a rectangular platform having a non-slip surface is fixed, such that the sports persons, when they place themselves on such platform, regardless of the exercise performed, prevent the bench from being lifted up, and moreover when performing the hip-thrust exercise with elastic bands or with a bar, and even combining them, the feet resting on such lower platform prevent the bench from slipping.

Therefore, the described improvement prevents the bench from being lifted up when the deadlift exercise is performed with elastic bands, in addition to prevent said bench from slipping while performing certain exercises.

Such platform has a non-slip surface to prevent the feet from slipping during the aforementioned hip thrust exercise.

Another variant, which involves another improvement, consists of the seat, rather than being ergonomic, being completely flat and significantly wide, supplemented with handles, which enable performing the reverse hyper exercise.

Lastly, it should be added that over the lower and central portions of the transverse beams joining the two sides of the frame, a ring could be fixed so an elastic band can pass through it, which would enable performing additional gluteus exercises, among others.

DESCRIPTION OF THE DRAWINGS

In order to complement the description being made below and with the aim of facilitating a better understanding of the invention characteristics, according to a preferred and practical exemplary embodiment thereof a set of drawings is attached as an integral part of said description, in which by way of non-limiting example, the following has been represented.

PREFERRED EMBODIMENT OF THE INVENTION

Figure 1:
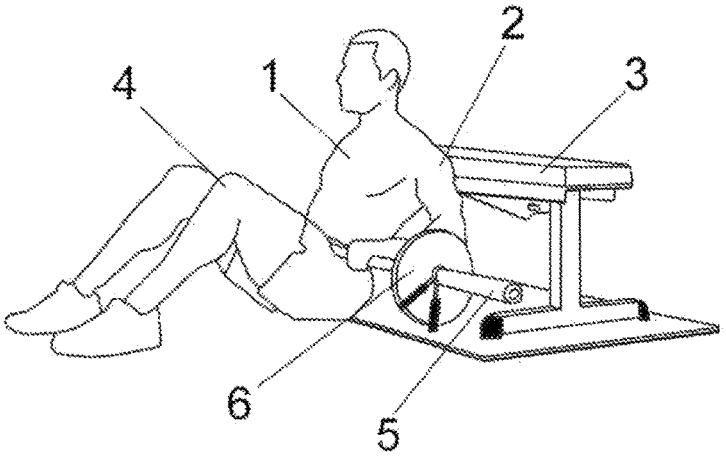
FIGS. 1 and 2.—Show both perspective views of the current state of the art, in which the limit positions of the exercise for which the bench of the invention is intended can be observed, but performed instead on a conventional bench.
Figure 2:
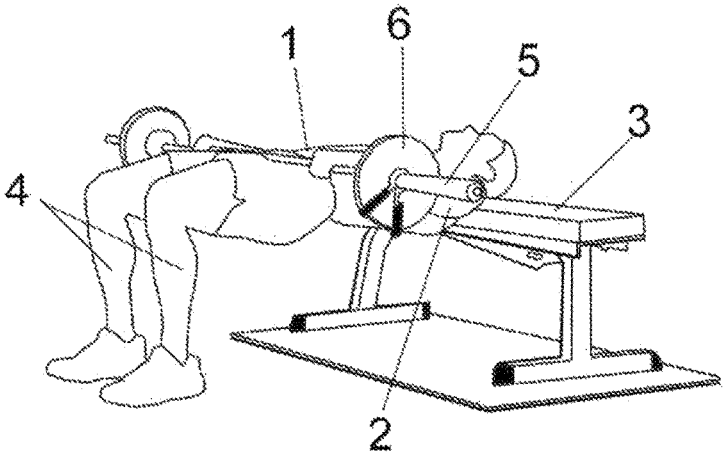

As can be seen in FIGS. 1 and 2, when performing the exercise known as "hip thrust", or hip extension with a bar, the sports persons (1) are seated on the floor, with their backs (2) resting against the bench (3), their legs (4) bent and the bar (5) with disks (6) positioned over their abdomen, such that the exercise consists of lifting the waist against the weight of the bar, using the back as a pivoting point for the body, so that in the upper limit position, the abdomen is in line with the knees, and the legs forming a right angle.

Figure 3:
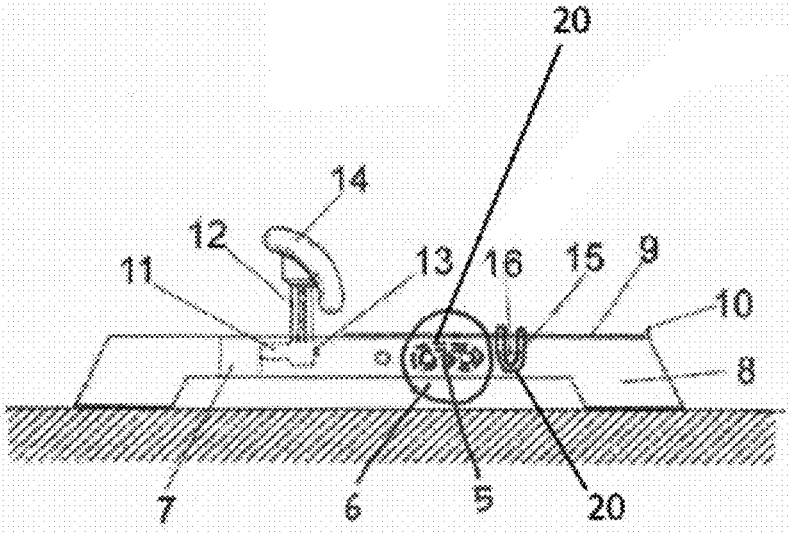
FIG. 3.—Shows, a side view of the bench object of the present invention.
Figure 4:
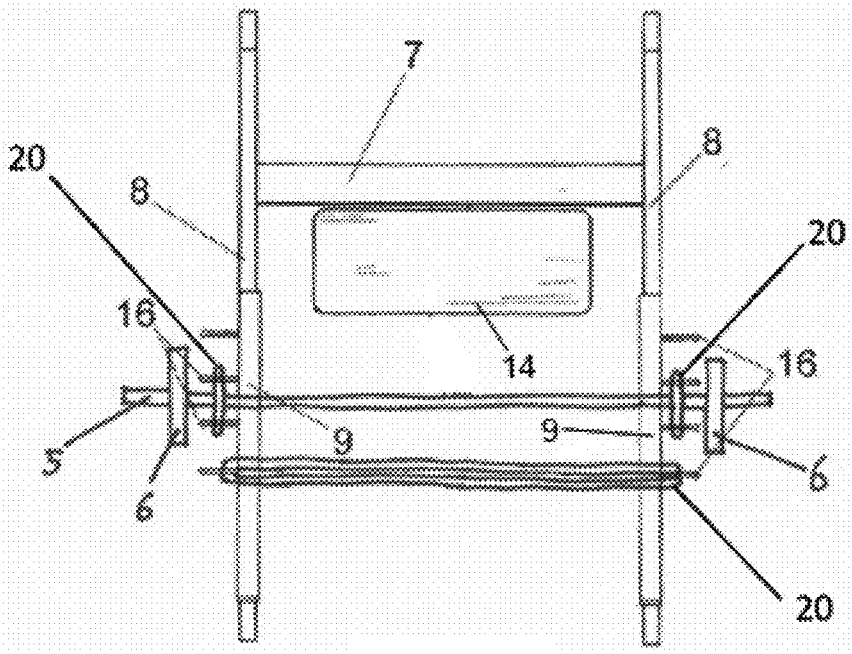
FIG. 4.—Shows, a plan view of the bench of the previous figure.

Well then, now according to the invention, and as can be seen in FIGS. 3 and 4, the bench of the invention is made up of an H-shaped frame having a middle beam (7) that is slightly shorter than the distance established between the disks (6) of the bar (5), such that the side beams (8) have on their upper surface, both guides (9) for sliding said bar, which end with both stops (10) at the ends thereof that prevent the bar from falling.

As far as the side beams are concerned (8), although they may have a large variety of configurations, such as for example, the bridge configuration shown in FIG. 2, in any event they all will have a common factor, i.e., the height thereof shall be high enough to enable the bar (5) to be rolled over the body of the user laying down on the floor, and short enough so the larger disks (6), in the resting position of the bar (5) over the guides (9), are as close as possible to the floor.

According to another feature of the invention, from the intermediate region of the crossbar (7) an arm (11) protrudes perpendicularly and horizontally, ending in a tubular recess, in which a pillar (12) can be moved vertically and adjusted in height by means of a pin (13), pillar which ends in a cushioned backrest (14) with ergonomic configuration, having an inclination in conformance with the types of exercises previously described, thereby making it possible to adopt different positions adjustable in height for said backrests.

Concurrently, it should be highlighted the fact that the side beams (8) may include a series of through holes (15) in which lugs (16) are selectively fitted for fixing closed elastic bands (20), such that by establishing an elastic band (20) on either side of the bench, between a pair of lugs and above the bar (5), the exercise is optimized, since the force to be exerted passes from being constant to being proportional, reaching the highest level of effort at the limit elevation point of the user's hip.

These lugs also make it possible to place a longer closed elastic band (20), transversely to the bench, which is arranged transversely to the users' abdomen, opposing the movement thereof.

These lugs also make it possible to place a longer closed elastic band, transversely to the bench, which is arranged transversely to the users' abdomen, opposing the movement thereof.

Figure 5:
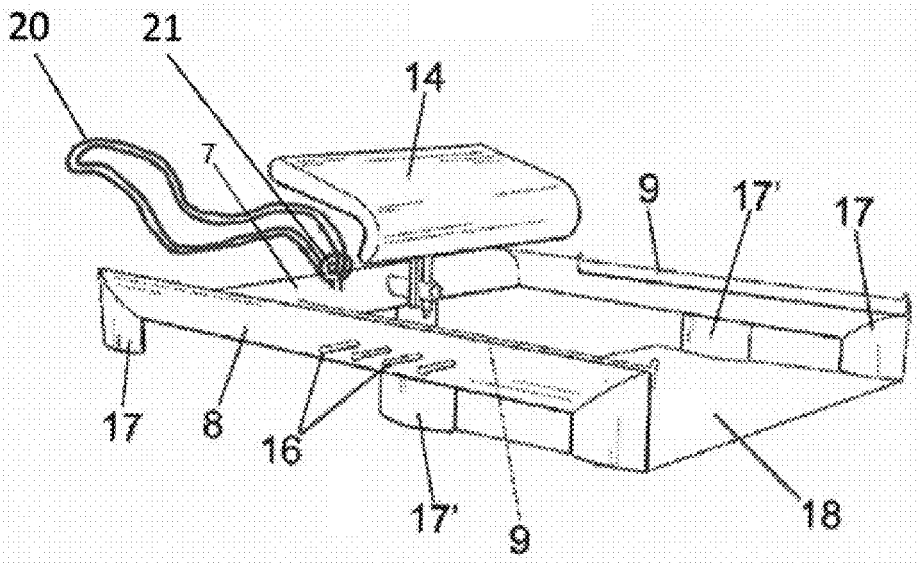
FIG. 5.—Corresponds to a general perspective view of the bench to carry out hip extensions with a bar, in a variant that involves an essential improvement of the invention.
Figure 6:
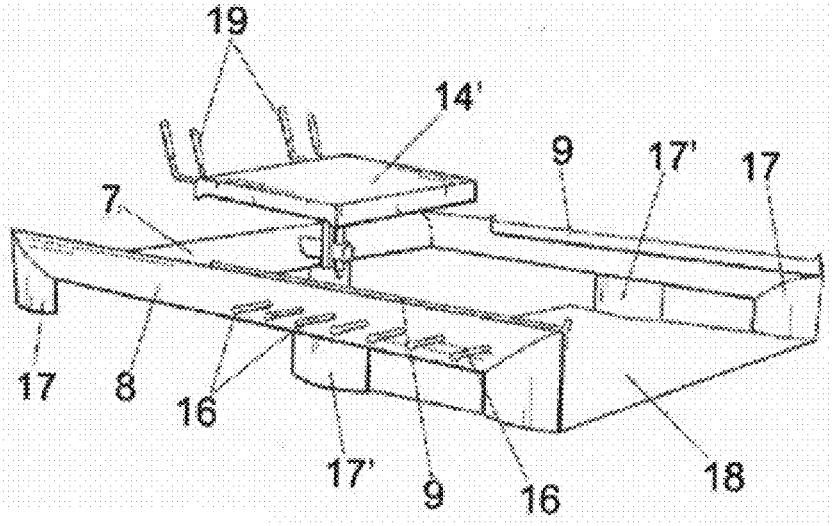
FIG. 6.—Corresponds to a view such as the one of the previous figure, but in a flat seat version with handles for the hands.

In an embodiment variant shown in FIGS. 5 and 6, it has been provided to include, at intermediate points of the sides (8), in addition to the end legs (17), a pair of intermediate legs (17'), between which legs and one of the pairs of legs (7), namely that of the rear end, a platform (18) having a non-slip surface is fixed, preferably by welding, such that when the sports persons perform a deadlift exercise, with rubber bands, the assembly of the bench will be prevented from lifting up relative to the floor, given that the same is secured to the lower platform (18) and the latter constitutes a platform on which the feet of the sports persons themselves are precisely resting.

Therefore, by means of the platform (18) with a non-slip surface, on the one hand the bench is prevented from lifting up when certain gym exercises are performed, and at the same time the feet are prevented from slipping, as well as, the platform itself when other exercises are performed, which entails a significant improvement.

Lastly, it should be mentioned that another improvement is based on the fact that the backrest or seat (14) rather than having an ergonomic configuration, as shown in FIG. 1, could be completely flat (14'), as shown in FIG. 2, and even wider, so as to make it possible performing another type of exercises, such as reverse hyper, wherein the bench, in addition to having such flat seat (14'), would have handles or grips (19) as well, so such exercise may be performed.

It should be pointed out that on the intermediate area of the transverse beam (7) of the frame, it is possible to fix a lower ring (21) in order to pass through the same an elastic band (20), which makes it possible to perform more gluteus and other exercises.

The special configuration of the bench makes it extremely stable, being it possible to incorporate in the legs thereof non-slip elements, as well as to lean against a wall, without that preventing the exercises intended for this device from being correctly carried out.

The invention claimed is:

1. A bench for performing hip thrusts with a barbell and disk-shaped weights, the bench comprising:

an H-shaped frame comprising two parallel side beams and a middle beam connected perpendicular to and between the parallel side beams; wherein the parallel side beams have respective first and second ends;

wherein the barbell is configured to roll over sliding guides provided on an upper surface of the parallel side beams of the H-shaped frame, where each of the sliding guides has a first end and a second end, and wherein each of the first and second ends of the sliding guides has an end stop; and wherein a backrest or seat is provided on the middle beam, where the backrest or seat comprises a seat adjustment mechanism;

an emergence or off-shoot projecting downwards from an intermediate portion of each of the parallel side beams of the H-shaped frame, the respective emergences or off-shoots forming intermediate legs;

and a platform that is fixed between the intermediate legs and a pair of end legs attached to the second ends of the respective parallel side beams, the platform configured to support feet of a user thereon, wherein the platform is non-slip to prevent the feet of the user from slipping while performing exercises.

2. The bench for performing hip thrusts with a barbell and disk-shaped weights according to claim 1, wherein the seat adjustment mechanism comprises an arm, a pillar and a pin; wherein the arm protrudes from an intermediate portion of the middle beam, and the pillar is telescopically disposed inside of the arm and is configured to move vertically inside of the arm to adjust a height of the backrest or seat, wherein the pin fixes the pillar relative to the arm.

3. The bench for performing hip thrusts with a barbell and disk-shaped weights according to claim 1, wherein the parallel side beams include a series of through holes in which lugs are selectively fitted for fixing closed elastic bands in a longitudinal direction, above ends of the barbell, and in a transverse direction, above a body of the user.

4. The bench for performing hip thrusts with a barbell and disk-shaped weights according to claim 1, wherein the parallel side beams of the bench extend in a rearward direction a length beyond the backrest or seat, and a length in a forward direction to a far edge of the platform.

5. The bench for performing hip thrusts with a barbell and disk-shaped weights according to claim 1, wherein the backrest or seat comprises a flat seat, and said flat seat has handles configured to allow the user to perform reverse hyper exercises.

6. The bench for performing hip thrusts with a barbell and disk-shaped weights according to claim 1, wherein the bench further includes a ring over a middle area of the middle beam of the H-shaped frame for passing an elastic band therethrough enabling the user to perform other exercises.

7. The bench for performing hip thrusts with a barbell and disk-shaped weights according to claim 1, wherein an inclination of the backrest or seat is adjustable.

* * * * *